US010494896B1

(12) United States Patent
Youngquist, Jr. et al.

(10) Patent No.: US 10,494,896 B1
(45) Date of Patent: Dec. 3, 2019

(54) CEMENTING CASING IN A LARGE DIAMETER MUD DRILLED WELL

(71) Applicant: Youngquist Brothers, Inc., Fort Myers, FL (US)

(72) Inventors: Harvey Bruce Youngquist, Jr., Estero, FL (US); Brett Alan Youngquist, Mont Belvieu, TX (US)

( * ) Notice: Subject to any disclaimer, the term of this patent is extended or adjusted under 35 U.S.C. 154(b) by 0 days.

(21) Appl. No.: 15/987,409

(22) Filed: May 23, 2018

(51) Int. Cl.

| | |
|---|---|
| ***E21B 33/14*** | (2006.01) |
| ***E21B 21/00*** | (2006.01) |
| ***E21B 37/02*** | (2006.01) |
| ***E21B 21/12*** | (2006.01) |
| *E21B 7/00* | (2006.01) |

(52) U.S. Cl.
CPC ..... *E21B 33/14* (2013.01); *E21B 21/00* (2013.01); *E21B 21/12* (2013.01); *E21B 37/02* (2013.01); *E21B 7/00* (2013.01)

(58) Field of Classification Search
CPC ..... E21B 21/00; E21B 21/12; E21B 21/14; E21B 21/16; E21B 33/14; E21B 37/02
See application file for complete search history.

(56) References Cited

U.S. PATENT DOCUMENTS

| | | | |
|---|---|---|---|
| 2,537,605 | A | 1/1951 | Sewell |
| 2,849,213 | A | 8/1958 | Failing |
| 3,419,092 | A | 12/1968 | Elenburg |
| 3,431,989 | A | 3/1969 | Waterman |
| 3,958,650 | A | 5/1976 | Cobbs et al. |
| 4,368,787 | A | 1/1983 | Messenger |
| 7,204,327 | B2 | 4/2007 | Livingstone |
| 7,870,683 | B2 | 1/2011 | Waid, Jr. |
| 7,878,247 | B2 | 2/2011 | Misselbrook et al. |
| 2016/0177637 | A1* | 6/2016 | Fleckenstein ..... E21B 33/14 166/285 |
| 2017/0234112 | A1 | 8/2017 | Pawar et al. |

OTHER PUBLICATIONS

Wikipedia, "Casing (borehole)", https://en.wikipedia.org/wiki/Casing_(borehole), 3/27/20188, pp. 1-4.
KGS—Petroleum: a primer for Kanasas—Drilling the well, http:.. www.kgs.ku.edu/Publications/Oil/primer12.html, Mar. 27, 2018, pp. 1-8.
Wikipedia, "Tremie", https://en.wikipedia.org/wiki/Tremie, Feb. 15, 2018, pp. 1-2.
United States Environmental Protection Agency (EPA), "Underground Injection Control Well Classes," https://www.epa.gov/uic/underground-injection-control-well-classes, Apr. 25, 2018, pp. 1-2.

* cited by examiner

*Primary Examiner* — Brad Harcourt
(74) *Attorney, Agent, or Firm* — Ted D. Lee; Gunn, Lee & Cave, P.C

(57) ABSTRACT

A method of cementing casing in a large diameter mud drilled well is shown. A drilling rig turns drill pipe with sufficient down pressure being applied to a drill bit to drill a large diameter borehole. Initially drilling mud flows down the annulus between the drill pipe and borehole, then back up the drill pipe. An air pressure line in the drill pipe creates a suction at the drill bit. Direction of flow of drilling mud is reversed when the drill pipe is replaced with casing. Cuttings and heavy mud are removed from the borehole by bi-directionally rotating a casing while reciprocating up and down near a bottom of the borehole. When the desired mud weight and viscosity is reached, mud flow is stopped and cement is applied through a tremie tube.

6 Claims, 6 Drawing Sheets

CEMENTING CASING IN A LARGE DIAMETER MUD DRILLED WELL

BACKGROUND OF THE INVENTION

1. Field of the Invention

This invention relates generally to the drilling of a large diameter well and, more particularly, to the cementing casing in a large diameter mud drilled well.

2. Description of the Prior Art

An oil and gas well is any perforation through the earth's surface designed to find and release oil and/or gas hydrocarbons. A well is created by drilling a hole into the earth with a drilling rig that rotates a drill string with a bit attached to the lower end. After the hole is drilled to a prescribed depth, sections of steel tubing known as casing are set in the hole. The casing is slightly smaller in diameter than the borehole. The casing provides structural integrity to the newly drilled wellbore and isolates zones from each other and from the surface. As the well is drilled deeper, smaller bits and smaller sized casing is used. Modern wells often have three to five sets of subsequently smaller hole sizes being drilled, each drilled inside one another and each cemented with a different size of casing.

The wells are normally formed with a drilling rig which creates holes or shafts in the ground. The drilling rig has a derrick that is tall enough to handle sections of drill pipe during the drilling process. The mechanical system includes a hoisting system for lifting heavy loads and numerous pieces of rotating equipment such as a swivel, kelly turntable or rotary table, drilling string and drill bit on the end of the drilling string. Diesel engines and electric generators normally provide power to the entire rig.

Different problems are incurred when attempting to use the same type of equipment to drill injection wells to depths of about 3,000 ft. The injection wells are large wells normally about sixty inches in diameter at the top, going down to about twenty-four inches in diameter at the bottom. These injection wells operate at very low pressure, normally around 20 psi and range in diameter from twenty inches to ninety inches. The injection wells are used to dispose of run-off water that should not be released into streams, but is not heavily polluted water like would be found in the oil filed environment.

The Environmental Protection Agency regulates injection wells under the Underground Injection Control program. There are six classes of injection wells. Each class of injection wells is based on the type and depth of the injection activity, and the potential for that injection activity to result in endangerment of underground sources of drinking water. The classes are as follows:

- Class 1 wells are used to inject hazardous and non-hazardous wastes into deep, isolated rock formations,
- Class II wells are used exclusively to inject fluids associated with oil and natural gas production,
- Class III wells are used to inject fluids to dissolve and extract minerals,
- Class IV wells are shallow wells used to inject hazardous or radioactive wastes into or above a geologic formation that contains an underground source of drinking water (USDW),

- Class V wells are used to inject non-hazardous fluids underground. Most Class V wells are used to dispose of wastes into or above underground sources of drinking water,
- Class VI wells are wells used for injection of carbon dioxide (CO2) into underground subsurface rock formations for long-term storage, or geologic sequestration.

Underground Injection Control regulations mandate the consideration of a variety of measures to assure that injection activities will not endanger underground sources of drinking water as defined in the Federal Code of Regulations (40 CFR 144.12).

When attempting to cement casing in place in large injection wells, the mud at the bottom of the well gets in the way and interferes with the cement. That is because the mud is about the same weight as the cement. Also, cuttings in the mud have a tendency to settle out at the bottom of the well In the oil field, the drilling mud (normally Bentonite) flows upward fast enough to take the cuttings to the top of the well. If normal oil field technology is used in the drilling of large diameter injection wells, the mud will not flow upward at a fast enough rate to lift the cuttings with the drilling mud.

Further, by the time the casing is welded together and lowered into the borehole, the cuttings and drilling mud will have settled back to the bottom of the borehole.

Because of the slow rise of the drilling mud in large diameter holes, the mud at the bottom of the borehole will be heavier than the mud at the top of the borehole due to the cuttings settling in the mud.

Also, in large diameter waste water disposal wells, clay that has been drilled and the drilling mud have a tendency to combine and form wall cake on the side of the borehole. Wall cake will interfere with the cementing of large diameter casing.

The cementing of a casing in place is performed by circulating a cement slurry through the inside of the casing and out into the annulus through a casing shoe at the bottom of the casing string. The cement slurry is pushed up through the annulus between the borehole and the casing. If the cement becomes mixed with cuttings, drilling mud and clay, it will not form a good bond with the casing. Also, if the drilling mud, clay and cuttings are not removed, the cement will tend to channel in the annulus between the borehole and the casing. This is especially true for large diameter waste water wells.

The current practice in cementing large diameter casing in a mud drill well is to drill to the desired depth with mud being pumped down the drill pipe and returned to the surface through the annulus between the outside of the drill pipe and the wellbore. During drilling, drilling mud such as Bentonite has a tendency to combine with clay to create wall cake on the wellbore.

After the drilling is complete, drilling mud is continually pumped through the drill pipe, drill bit and up through the annulus between the drill pipe and the wellbore. This is referred to as "conditioning the well" to hopefully reach the desired mud weight. When the desired mud weight is reached, pumping of the drilling mud is stopped and the drill string and drill bit are taken out of the well.

Next, the steel casing is installed in the wellbore with each joint between the steel casing being welded into place. This process potentially can take several days. During that time, the cuttings that are suspended in the drilling mud have a tendency to settle to the bottom of the well. Also, clay in the formation may expand and sink in the drilling fluid.

A cement header is installed at the top of the casing with a flange for a tremie tubing. Cement is pumped through the tremie tubing with the cement flowing out the bottom of the casing and, thereafter, through the path of least resistance between the outside of the casing and the annulus formed with the wellbore.

The problem with the method just described in drilling large diameter holes is a sufficient upward velocity of the drilling mud to carry the cuttings to the is not obtainable with currently available surface mud handling equipment. The upward velocity of the drilling mud is insufficient to carry the cuttings to the surface as necessary. In a sixty-two inch diameter borehole, the drilling mud returns to the surface through the annulus between the wellbore and the drill pipe at a velocity of approximately 9.7 ft./min. This is insufficient to raise drill cuttings and heavy particles to the surface.

In the period of time that passes between the conditioning of the well (i.e., pumping of drilling mud) and starting the cement pump, there is a non-uniform settling of cuttings and other particles in the bottom portion of the wellbore. Therefore, when the cement pump starts, the cement channels through the path of least resistance in the annulus between the outside of the casing and the wellbore. Channels of cement travel up through these holes of least resistance around the clay and the other solids.

There is a theoretical cement volume that will be necessary to completely cement the annulus between the casing and wellbore. However, in virtually every occasion after cementing of the casing in a mud drilled well, the actual pump volume of cement is less than a theoretical calculated volume of cement required to fill the annulus between the casing and the borehole. This is because there are uncemented voids in the area between the outside of the casing and the wellbore.

More specifically, Class 5 injection wells are used for aquifer storage and recovery, storm water disposal, aquiculture waste water, geothermal exchange and other uses allowed by the Environmental Protection Agency under the Underground Injection Control guidelines. The problems mentioned above apply to Class 5 injection wells.

SUMMARY OF THE INVENTION

It is an object of the present invention to cement the casing in a large diameter mud drilled well.

It is another object of the invention to reverse the direction of mud flow to increase the velocity of drilling mud with cuttings suspended therein to the top of the wellbore to remove more cuttings or suspended solids.

It is yet another object of the present invention to remove excessive wall cake, heavy mud and cuttings by vacuuming the bottom of the wellbore.

It is still another object of the present invention to use bi-directional agitators attached to the outside of the casing so that upon rotation and reciprocating of the casing, the bi-directional agitators will help clear the annulus between the casing and the wellbore.

In the present invention, the directional flow of the drilling mud is changed so that drilling mud is pumped down the annulus between the drill pipe and the wellbore and back up through the drill bit and drill pipe to the surface. An air pressure pipe is installed inside of the drill pipe. Pressurized air flows out the bottom of the air pressure pipe above the drill bit and up the drill pipe to the surface. High pressure compressed air is pumped through the air pressure pipe, which returns to the surface outside of the air pressure pipe, but inside of the drill pipe. This creates a pressure to differential that sucks drilling mud and any particles therein from the bottom of the wellbore up through the drill bit and drill pipe.

As an alternative to using an air pressure pipe inside of the drill pipe, it is possible to use high-pressure pumps on the surface to pump fluid down the annulus between the outside of the drill pipe and inside the first string of casing and there below inside the wellbore. This will force the drilling mud to return to the surface up the drill pipe which will be at a higher velocity.

By using this reverse direction flow, the velocity of the drilling mud returning to the surface reaches up to 250 ft/min. The increased velocity makes it possible to lift heavier drilling mud and cuttings out of the well.

During continued drilling with the reverse flow for the drilling mud, the drilling mud continues sucking up new cuttings through the drill bit up through the drill pipe and to the surface until the desired depth is reached. At least one wiper trip occurs where the drill bit is raised either up to the previously set casing or to the surface and then back down to the bottom. Once the bit is back to the bottom of the wellbore, it is raised either up to the previously set casing or to the surface and then back down to the bottom. Once the bit is back down to the bottom of the well, reverse flow drilling mud will continue with additional vacuuming of the cuttings and the heavy drilling mud through the drill bit and drill pipe.

While rotating the drill bit and drill pipe, the drill bit is reciprocated up approximately ninety feet and back down several times. After confirming the drilling mud has reached an acceptable viscosity and weight, the drill pipe and bit are removed from the well.

The casing with bi-directional self-cleaning agitators is now lowered into the wellbore. Each consecutive section is welded to the casing string and lowered into the wellbore until the entire casing string is set to the desired depth. An offset tremie cementing header is attached to the top of the casing. The top head drive is connected to the cement header. A tremie tube for cement extends down from the offset tremie to approximately five feet from the bottom of the casing. The casing is rotated both clockwise and counterclockwise while reciprocating up and down. The cement hose will wrap around the outside of the casing while rotating in either direction. The pumping of drilling mud occurs through the kelly hose connecting to the top head into the drill pipe into the bottom of the casing and back up through the annulus between the casing and the wellbore.

Bi-directional rotation and reciprocating of the casing occurs until the desired mud weight is verified. Also, enough time must pass for the bi-directional self-cleaning agitators to scrape clay and drilling mud called wall cake from the inside of the wellbore. The valve for the drilling mud is cut off and, thereafter, cement is pumped down the offset tremie and tremie tubing. Pressure inside the casing will force the cement out of the casing and up the annulus between the casing and the wellbore. When the pressure tries to push the casing out of the well, the casing is secured against further movement. After pumping the desired amount of cement, the pump is stopped and the pressure inside the casing is maintained until cement has time to cure. The tremie tubing is removed from inside the casing and a tremie tubing is run down an annulus between the casing and the wellbore. After tagging the top of the cement, cementing to the surface with a tremie tubing between the outside of the casing and the wellbore is started.

DESCRIPTION OF THE PREFERRED EMBODIMENT

Figure 1:
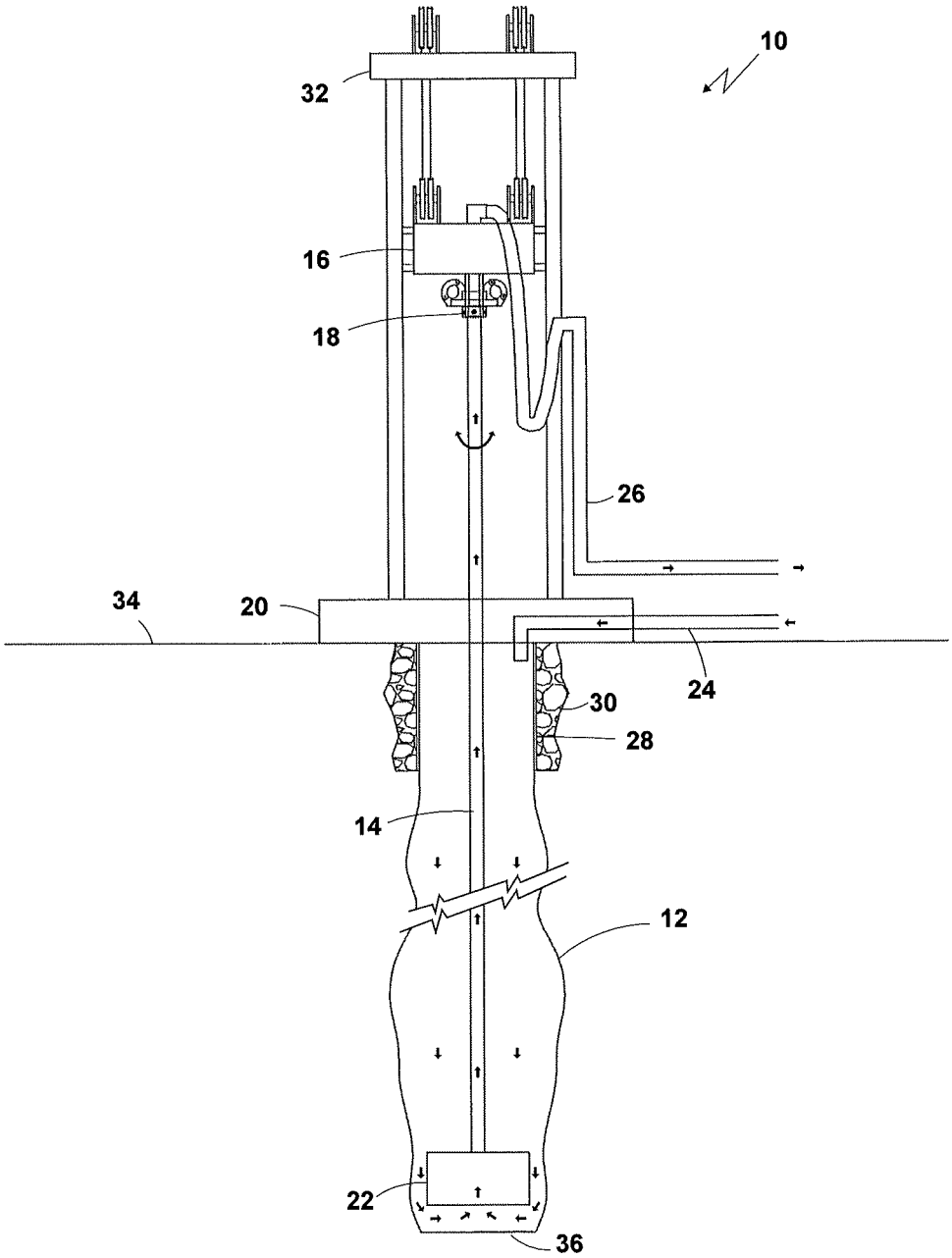
FIG. 1 is an elevated pictorial illustration of a large diameter well being drilled with drilling mud.

Referring to FIG. 1, a drilling rig 10 is pictorially illustrated above a wellbore 12. The wellbore 12 is for a large diameter waste water disposal well. Such large diameter disposal wells may be about sixty inches in diameter at the top and be reduced down to twenty-four inches in diameter at the bottom. Such large diameter wells can range from 20 inches in diameter to 90 inches in diameter.

A drill pipe extends down from the top head drive 16 and the drill pipe connection 18 through the drilling floor 20. The top head drive 16 rotates the drilling pipe 14 which has on the lower end thereof a drill bit 22. Because the borehole being drilled has a large diameter (approximately sixty-two inches), the drill bit 22 will be much larger in diameter than the drill pipe 14.

Drilling mud such as Bentonite flows into the wellbore 12 through drilling mud tubing 24. The drilling mud flows downward in the wellbore 12 in through the drill bit 22, up the drill pipe 14, through drill pipe connection 18, through top head drive 16 and out drilling mud return line 26.

During the beginning of drilling operations, also known as "spudding in," a surface casing 28 is installed and secured in place by upper cement 30. A top head drive 16 turns the drill pipe 14.

An air pressure pipe (not shown) is run several hundred feet down the drill pipe 14. Applying high-pressure compressed air through the air pressure pipe, the air returns to the surface inside of the drill pipe 14. This creates a pressure differential that "sucks" fluid up through the drill pipe 14 from the bottom 36 of the wellbore 12. The drilling fluid returning to the surface up through the drill bit 22 and the drill pipe 14 is moving upward at a velocity of approximately 250 ft./min. This upward velocity helps maintain the cuttings, clay and other particles in the drilling mud to the surface. The lower the velocity, the more the cuttings and other particles would remain suspended in the wellbore 12.

As an alternative to using an air pressure pipe inside of the drill pipe 14, high pressure pumps on the surface can pump fluid down the annulus between the outside of the drilling pipe and inside the first string of casing and there below inside the wellbore. This will force fluid to return to the surface up the drill pipe 14.

This drilling process with the reverse mud flow sucking cuttings up through the drill bit 26 and drill pipe 14 is continued until the desired depth of the wellbore 12 is reached. A typical depth and diameter for waste water disposal well is three thousand feet deep with a beginning diameter of up to ninety inches.

After reaching the desired depth, at least one wiper trip is performed where the bit 22 is raised up to the surface casing 28 (or any other previously set casing) or to the surface 34 and subsequently lowered back down to the bottom 36. Once the bit 22 is back at the bottom 36 of the wellbore 12, the reverse circulation of drilling mud and the "vacuuming" of cuttings and heavy drilling mud up through the drill pipe 14 continues. While rotating the drill pipe 14 and the drill bit 22 and vacuuming, the drill bit 22 is raised approximately ninety feet and lowered back down to the bottom 36 several times.

On the surface, the drilling mud returning to the drilling mud return line 26 is tested to confirm it has an acceptable viscosity and weight before the drill pipe 14 and drill bit 26 are removed from the wellbore 12.

Figure 2:
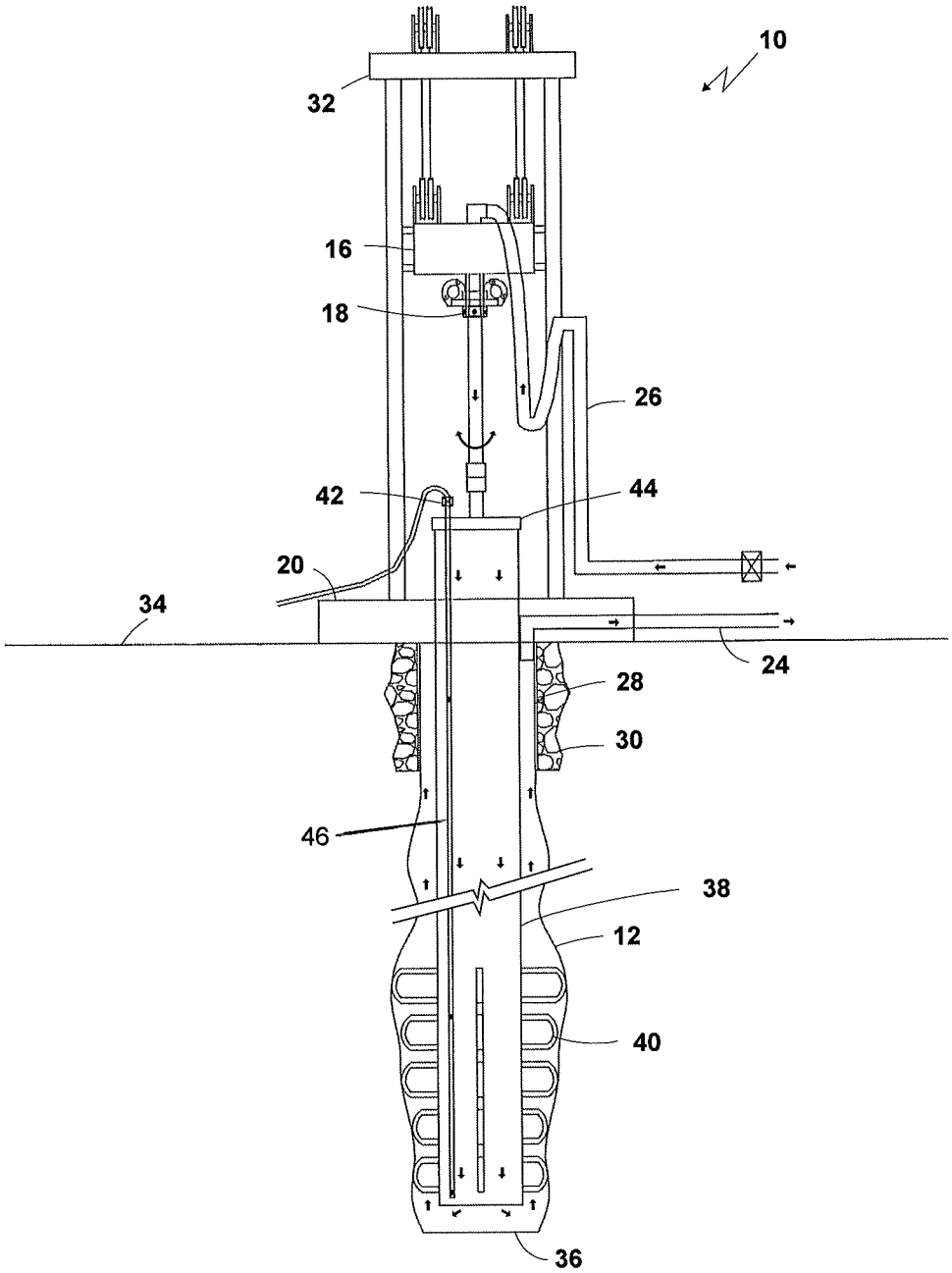
FIG. 2 is a sequential view of FIG. 1 with large diameter casing being installed.
Figure 6:
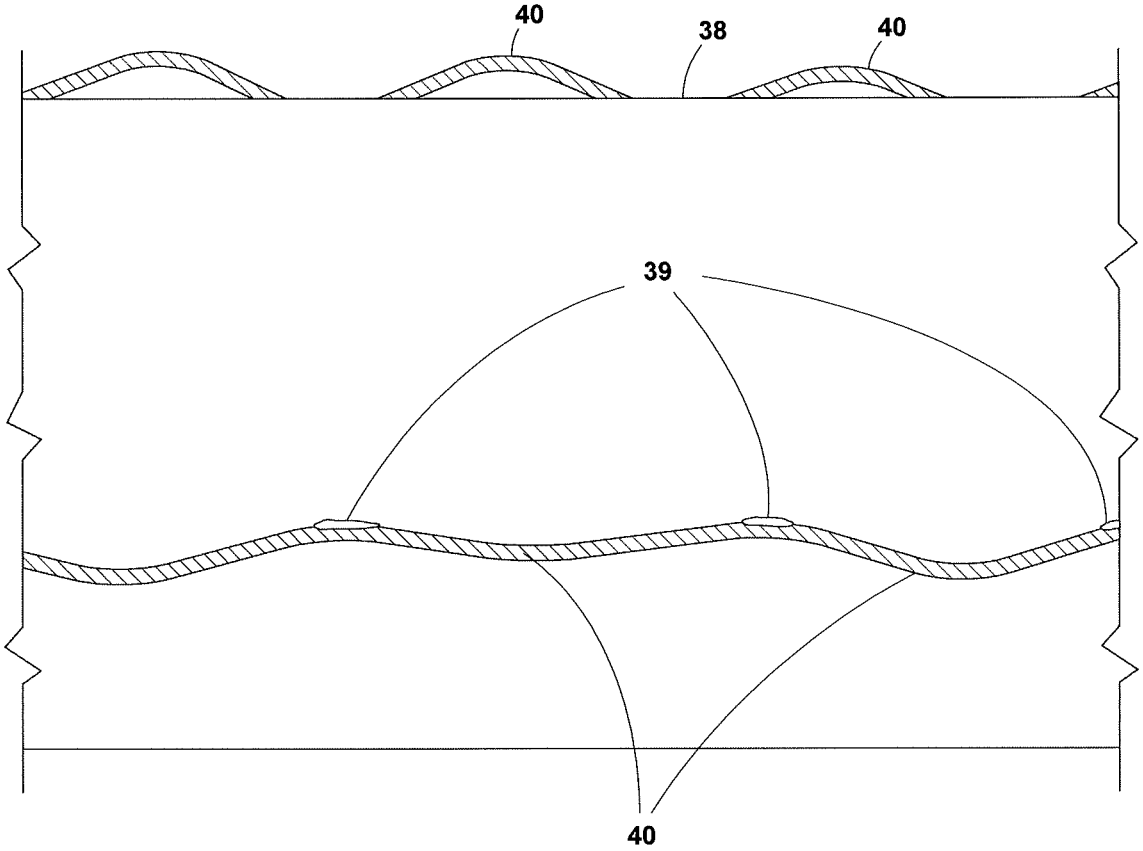
FIG. 6 is an elongated view of a large diameter casing with bi-directional and self-cleaning agitators.

In place of the drill pipe 14 and drill bit 22, a casing 38 is lowered into the wellbore 12. See FIG. 2. To install the casing 38, it has to be installed in sections of either twenty or forty foot lengths, which sections have to be welded together. On the outside of the large diameter steel pipes are bi-directional self-cleaning agitators 40. The bi-directional self-cleaning agitators 40 may be made of steel cables welded loosely to the outside of the casing 38 with weld joints 39. This can be seen pictorially in FIG. 6.

Each consecutive joint of the casing 38 must be welded into the casing string and lowered into the wellbore 12. This continues until the entire casing string is set to the desired depth.

An offset tremie 42 is placed in the cementing header 44. The top head drive 32 is connected to the cementing header 44 via top head drive 16 and drill pipe connection 18.

A tremie tube 46 is connected to the offset tremie 42, which tremie tube extends to approximately five feet above the bottom 52 of casing 38. See FIG. 3.

Figure 3:
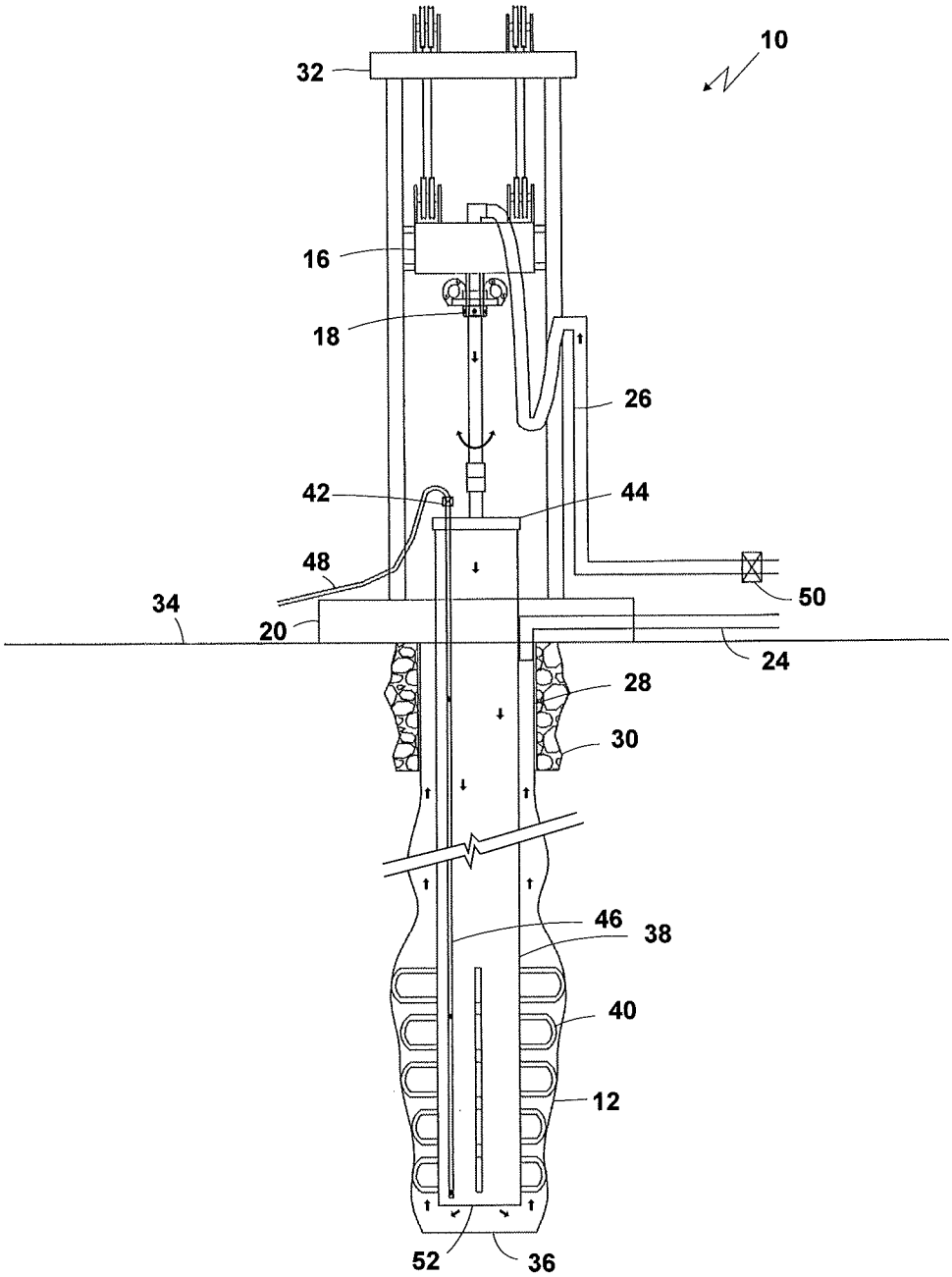
FIG. 3 is a sequential view of FIG. 1 with bi-directional and self-cleaning agitators and a tremie tube installed.
Figure 4:
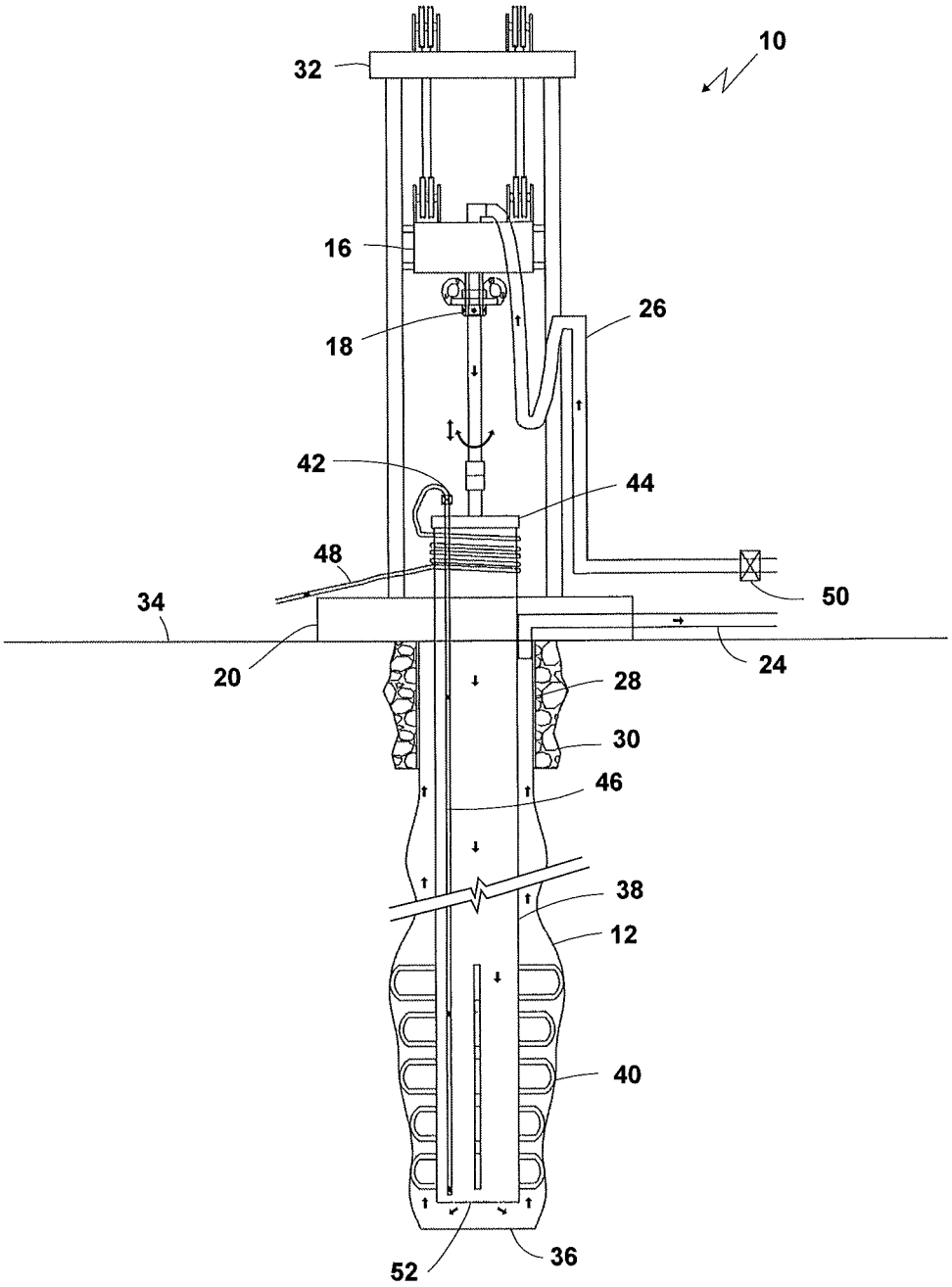
FIG. 4 is a sequential view of FIG. 1 with the casing being bi-directionally rotated and reciprocated.
Figure 5:
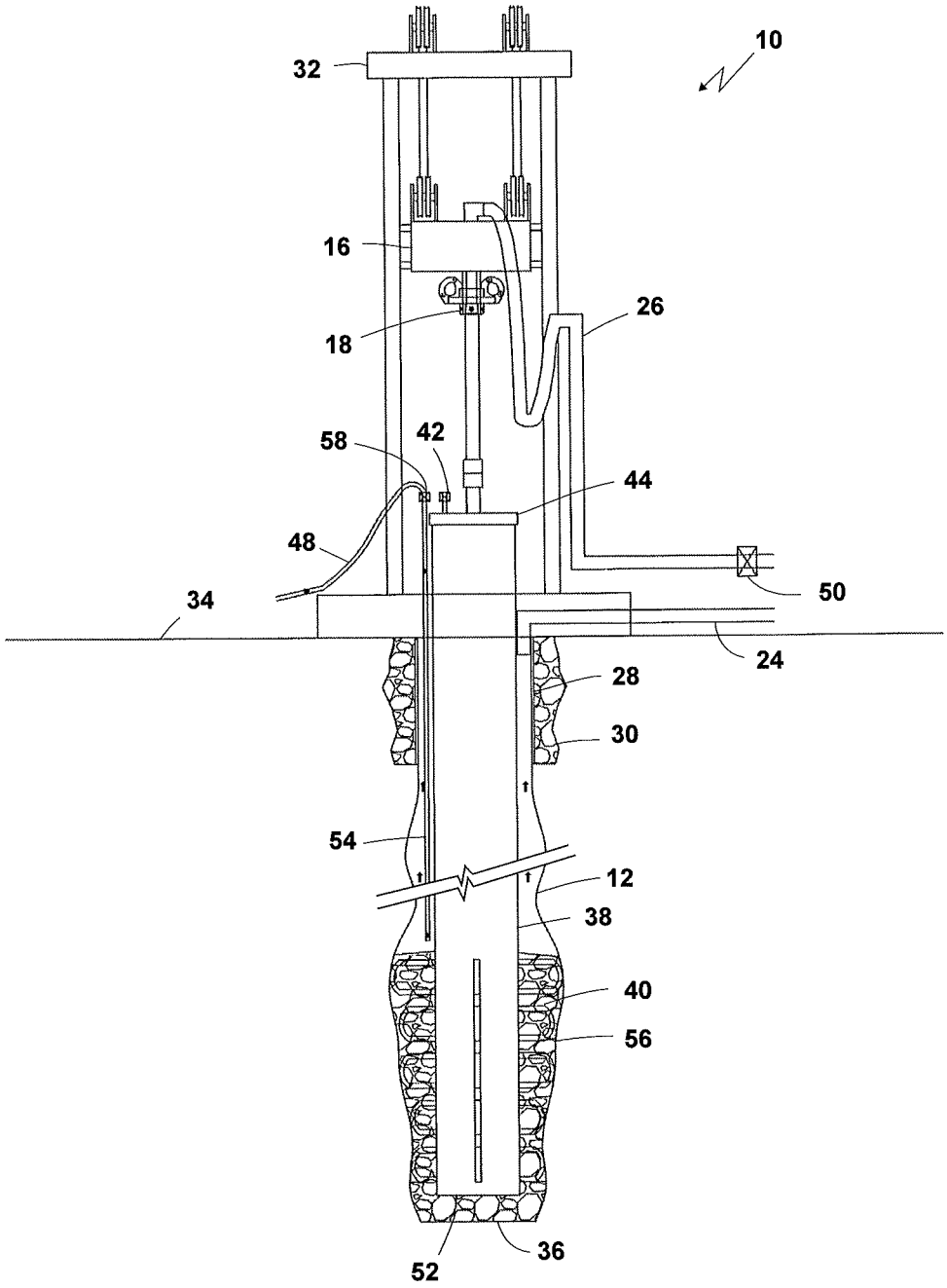
FIG. 5 is a sequential view of FIG. 1 with cement being injected in an annulus outside a large diameter casing.

Referring FIGS. 3 and 4 in combination, the casing 38 is bi-directional rotationed clockwise, then counter-clockwise, while being reciprocated up and down. The cement hose 48 will wrap around the outside of the casing 38, while the casing 38 is rotating in either direction (see FIG. 4). By pumping drilling mud through the previous drilling mud return line 26 and into the casing 38, the drilling mud will flow up through the annulus between the casing 38 and the wellbore 12 as pictorially illustrated in FIGS. 3 and 4. By the pumping of drilling mud through the casing 38 and up the annulus between the casing 38 and the wellbore 12, the drilling mud will have an upward velocity of approximately 39.6 ft./min.

By continuing the bi-directional rotating and reciprocating motion of the casing 38, the bi-directional self-cleaning agitators 40 scrape the clay and the drilling mud called "wall cake" from the inside of the wellbore 12. Enough time is allowed to pass until the wall cake from the inside of the wellbore 12 has had a chance to be carried to the surface 34. The drilling mud with the suspended cuttings and wall cake flow out drilling mud tubing 24.

After sufficient time has passed, valve 50 is closed, stopping the flow of drilling mud into casing 38. Thereafter, cement is pumped through cement hose 48, offset tremie 42 and tremie tube 46 to the casing bottom 52. The pressure within the casing 38 will force the cement out of the casing 38 and into the annulus between casing 38 and wellbore 12. When the up shove of the pressure tends to push the casing 38 out of the wellbore 12, the casing 38 is secured against further movement. After the desired amount of cement is pumped through the offset tremie 42, the pumping is stopped, but pressure is maintained on the casing 38 until the cement has had time to cure. Then, the tremie tube 46 is removed and an outside tremie tube 54 is installed in the annulus between the casing 38 and the wellbore 12. See FIG.

5. The cured cement 56 is shown around casing 38 in the bottom 36 of the wellbore 12.

By following the procedure just described, very little (if any) of the drilling mud cuttings, wall cake or other suspended particles will be within the cured cement 56. Now the cement hose 48 is connected to tremie connection 58 to the offset tremie tube 54. Cementing then occurs from the top of the cured cement 56 to the surface 34. The outside tremie tube 54 is raised as the cement is deposited so that the lower tip of the outside tremie tube 54 remains at the surface of the cement being deposited. This occurs until the cement reaches the surface 34.

By following the procedure just described, a large diameter waste disposal well can be drilled, cased and cemented with a good bond between the cement and the casing.

What we claim is:

1. A method of cementing casing in a large diameter mud drilled well using a drilling rig that can raise and lower drilling pipe or casing, a supply of drilling mud and cement, said drilling rig applying down hole pressure as needed, said method including the following steps:

drilling a large diameter borehole using said drilling pipe connected to said drilling rig, said drilling pipe having a drill bit on a lower end thereof, said drill bit being large enough to drill said large diameter borehole;

pumping said drilling mud down said large diameter borehole, through said drill bit, and back up said drill pipe;

injecting high pressure air through an air pressure line inside said drilling pipe and back up said drilling pipe to create a suction at said drill bit;

continue drilling said large diameter borehole to a desired depth;

reciprocating said drill bit up and down at a bottom of said large diameter borehole during said suction to remove cuttings and heavy drilling mud;

confirming said drilling mud has reached an acceptable viscosity and weight;

removing said drilling pipe and said drill bit from said large diameter borehole;

installing a large diameter casing with a tremie tube in said large diameter borehole;

bi-directionally rotating said large diameter casing while (1) reciprocating up and down in said large diameter borehole and (2) pumping said drilling mud into said large diameter casing and up an annulus between said large diameter casing and said large diameter borehole;

simultaneous scraping wall cake off said large diameter borehole with bi-directional self-cleaning agitators on an outside of said large diameter casing;

verifying desired weight of said drilling mud has been reached, then (1) stopping said pumping of said drilling mud and (2) pumping said cement down said tremie tube while bi-directionally rotating said large diameter casing until a desired amount of said cement has been pumped;

stopping motion of said large diameter casing to allow said cement to cure;

pumping additional cement down a second tremie tube in said annulus to a top of said large diameter borehole; and allowing said additional cement to cure.

2. The method of cementing casing in a large diameter mud drilled well as recited in claim 1 further includes prior to said simultaneous scraping wall cake off said large diameter borehole attaching said bi-directional self-cleaning agitators to an outside of said large diameter casing.

3. The method of cementing casing in a large diameter mud drilled well as recited in claim 2, wherein said bi-directional self-cleaning agitators are steel cables (1) spot welded to an outside of said large diameter casing, but (2) loose enough to scrape off said wall cake inside said large diameter borehole.

4. The method of cementing casing in a large diameter mud drilled well as recited in claim 3, wherein during said bi-directionally rotating step, a distance of said reciprocating up and down in said large diameter borehole is approximately ninety feet.

5. The method of cementing casing in a large diameter mud drilled well as recited in claim 4, wherein before said reciprocating step, raising said drill bit to near the surface and subsequently lowering said drill bit to said bottom.

6. A method of cementing casing in a large diameter mud drilled well using a drilling rig that can raise and lower drilling pipe or casing, a supply of drilling mud and cement, said drilling rig applying down hole pressure as needed, said method including the following steps:

drilling a large diameter borehole using said drilling pipe connected to said drilling rig, said drilling pipe having a drill bit on a lower end thereof, said drill bit being large enough to drill said large diameter borehole;

pumping said drilling mud down said large diameter borehole, through said drill bit, and back up said drill pipe;

injecting high pressure fluid down an annulus between said drilling pipe and said large diameter borehole, then back up said drilling pipe to create a suction at said drill bit;

continue drilling said large diameter borehole to a desired depth;

reciprocating said drill bit up and down at a bottom of said large diameter borehole during said suction to remove cuttings and heavy drilling mud;

confirming said drilling mud has reached an acceptable viscosity and weight;

stopping said injecting step;

removing said drilling pipe and said drill bit from said large diameter borehole;

installing a large diameter casing with a tremie tube in said large diameter borehole;

bi-directionally rotating said large diameter casing while (1) reciprocating up and down in said large diameter borehole and (2) pumping said drilling mud into said large diameter casing and up an annulus between said large diameter casing and said large diameter borehole;

simultaneous scraping wall cake off said large diameter borehole with bi-directional self-cleaning agitators on an outside of said large diameter casing;

verifying desired weight of said drilling mud has been reached, then (1) stopping said pumping of said drilling mud and (2) pumping said cement down said tremie tube while bi-directionally rotating said large diameter casing until a desired amount of said cement has been pumped;

stopping motion of said large diameter casing to allow said cement to cure;

pumping additional cement down a second tremie tube in said annulus to a top of said large diameter borehole; and allowing said additional cement to cure.

* * * * *